US006752671B2

(12) United States Patent
Ishigaki et al.

(10) Patent No.: US 6,752,671 B2
(45) Date of Patent: Jun. 22, 2004

(54) WATER JET PROPULSION TYPE OUTBOARD ENGINE

(75) Inventors: Eiichi Ishigaki, Kagawa (JP); Koji Ishimoto, Kagawa (JP); Takahiro Goto, Kagawa (JP); Kazuhisa Ishimura, Kagawa (JP); Kazumitsu Oura, Kagawa (JP)

(73) Assignee: Shigaki Company Limited, Tokyo (JP)

( * ) Notice: Subject to any disclaimer, the term of this patent is extended or adjusted under 35 U.S.C. 154(b) by 0 days.

(21) Appl. No.: 10/239,871

(22) PCT Filed: Feb. 15, 2002

(86) PCT No.: PCT/JP02/01307

§ 371 (c)(1),
(2), (4) Date: Oct. 3, 2002

(87) PCT Pub. No.: WO02/066322

PCT Pub. Date: Aug. 29, 2002

(65) Prior Publication Data

US 2003/0143901 A1 Jul. 31, 2003

(30) Foreign Application Priority Data

Feb. 21, 2001 (JP) ..... 2001-044974

(51) Int. Cl.[7] ..... B63H 11/04

(52) U.S. Cl. ..... 440/39; 440/88 M; 440/88 N; 440/89 R; 440/89 B

(58) Field of Search ..... 440/38, 39, 40–43, 440/46, 88 C, 88 M, 88 N, 88 P, 89 R, 89 B

(56) References Cited

U.S. PATENT DOCUMENTS

| | | | | |
|---|---|---|---|---|
| 3,249,083 A | * | 5/1966 | Irgens | 440/47 |
| 4,459,117 A | * | 7/1984 | Jordan | 440/38 |
| 5,769,674 A | * | 6/1998 | Stallman | 440/38 |
| 6,036,556 A | * | 3/2000 | Baker et al. | 440/38 |
| 6,095,166 A | | 8/2000 | Yoshimura et al. | |
| 6,168,485 B1 | | 1/2001 | Hall et al. | |
| 6,283,805 B1 | * | 9/2001 | Ishigaki | 440/46 |
| 2003/0104733 A1 | * | 6/2003 | Ishigaki et al. | 440/71 |

FOREIGN PATENT DOCUMENTS

| | | | |
|---|---|---|---|
| JP | 7-33085 | | 2/1995 |
| JP | 8-253196 | | 10/1996 |
| JP | 9-39892 | | 2/1997 |
| JP | 9-41964 | | 2/1997 |
| JP | 9-309492 | | 12/1997 |
| JP | 11-82021 | | 3/1999 |
| JP | 11286297 | | 10/1999 |
| JP | 2000-128084 | * | 5/2000 |
| JP | 2000-168686 | | 6/2000 |
| WO | WO99/61312 | * | 12/1999 |

OTHER PUBLICATIONS

English Language Abstract of JP 9–309492.
English Language Abstract of JP 2000–168686.
English Language Abstract of JP 11–82021.
English Language Abstract of JP 9–41964.
English Language Abstract of JP 7–33085.
English Language Abstract of JP 8–253196.
English Language Abstract of JP 11–286297.
English Language Abstract of JP 9–39892.

* cited by examiner

*Primary Examiner*—Sherman Basinger
(74) *Attorney, Agent, or Firm*—Greenblum & Bernstein, P.L.C.

(57) ABSTRACT

A water jet propulsion type outboard motor which includes: a power source; a driving system; a housing; a curved tubular duct member; guide blades; and an impeller. The duct member is fixed to the housing on which the power source is mounted, and having a suction port and a discharge port. The guide blades are provided within the duct member in the vicinity of the discharge port of the duct member. The impeller is rotated by the driving system for transmitting a driving power of the power source, and has a spiral blade with outer peripheral edge thereof close to an inner peripheral face of the duct member, and outer peripheral distal end portion thereof extending toward the suction port.

17 Claims, 13 Drawing Sheets

WATER JET PROPULSION TYPE OUTBOARD ENGINE

TECHNICAL FIELD

The present invention relates to a water jet propulsion type outboard motor, in particular, to an improvement of a water anti-splash device also serving as a water intake unit for cooling water, an exhaust system for reducing exhaust noise, and a movable screen.

BACKGROUND ART

Japanese Patent Application Laid-Open NO.9 (1997)-309492 discloses a water jet propulsion type outboard motor including an impeller that is housed within a duct having a suction port and a nozzle: water sucked from the suction port is pressurized the impeller to be jetted out from the nozzle to propel a ship. However, since the impeller of this outboard motor consists of axial flow blades, a thrust obtained with such an impeller is limited. Moreover, since the pressurized water in the duct is used as cooling water for an engine, sand flowing through the suction port gets mixed in with the cooling water for the engine.

Japanese Patent Application Laid-Open NO.11 (1999)-286297 discloses a splashproof device for an outboard motor, in which a horizontal plate type splashboard is provided between the outboard motor and a ship so as to prevent an increase in running resistance caused by water striking against the outboard motor as well as to prevent water from splashing into the ship. However, this splashproof device is not capable of preventing water splashing from the stern from striking against a side face of the outboard motor when the outboard motor is rotated to change the running direction. Therefore, this splashproof device cannot prevent resistance from being increased. Moreover, water striking against the side face of the outboard motor splashes into the ship.

Japanese Patent Application Laid-Open NO.9 (1997)-39892 discloses a water jet propulsion type outboard motor, in which a swirl water flow pressurized with an impeller is conveyed to a volute casing to be jetted out from a discharge port so as to propel a ship. However, since this outboard motor vertically sucks water from a suction port, there is a possibility that cavitation may occur due to negative pressure at the suction port while the ship is running. Moreover, exhaust gas from an engine is directed to an underwater exhaust chamber, to which high-pressure water in the volute casing is supplied, so that energy of the exhaust gas is absorbed by the water so as to deaden the noise. However, since the high-pressure water is supplied to the underwater exhaust chamber through a hole provided through the volute casing, energy loss is generated.

Japanese Patent Application Laid-Open NO.8 (1996)-253196 discloses a screen for debris removal, which is fixed over an inlet port of a suction casing so as to prevent debris floating under the water and on the water surface from being sucked inside. However, since this screen is fixed, it is necessary to remove screws, pins or the like which fix the screen in order to remove debris such as vinyl or cords passing through the screen and caught on an entry section of an impeller. Therefore, it is difficult to remove debris when a ship is on the water.

DISCLOSURE OF INVENTION

In view of the conventional problems as described above, the present invention has an object of providing a small and light-weight safety water jet propulsion type outboard motor with high propulsion efficiency.

Another object of the present invention is to provide a water intake unit for preventing sand or the like from getting mixed with cooling water, an anti-splash device for preventing an increase in running resistance due to collision of a water flow splashing from a stern against a propulsion device and for preventing water from splashing into a ship, an exhaust system for reducing exhaust noise to lower the operation noise, and a movable screen for facilitating the removal of debris or the like.

In order to achieve the above objects, a water jet propulsion type outboard motor according to a first aspect of the present invention includes: a power source; a driving system for transmitting a driving power of the power source; a curved tubular duct member fixed to a housing on which the power source is mounted, having a suction port and a discharge port; guide blades provided within the duct member, in the vicinity of the discharge port thereof; and an impeller enclosed by the duct member and rotated by the driving system, wherein an outer peripheral edge of a spiral blade of the impeller provided around its hub is close to an inner peripheral face of the duct member, and an outer peripheral distal end portion of the impeller extends toward the suction port.

In the above structure, since the impeller is enclosed within the duct member for protection, the impeller does not come into contact with obstacles such as sand or rocks. Therefore, according to the outboard motor including the impeller, the safe running of a ship can be provided even in shallows such as in the vicinity of a shoreline or on a river.

Moreover, since the duct member has a curved tubular shape, a length of the duct member can be reduced, thereby reducing the outboard motor in size as well as in weight. Therefore, since the outboard motor does not protrude backward from the ship, the amount of band-shaped objects caught on the outboard motor or the contact with the driftwood or the like is decreased, thereby increasing the working rate and enhancing the safety of the outboard motor.

Since the outer peripheral edge of a spiral blade is close to an inner peripheral face of the duct member so as to give an axially symmetrical energy to a fluid in a cross section vertical to a rotation axis of the impeller, balance efficiency is improved. Moreover, the outer peripheral distal end portion of the spiral blade extends to the side of the suction port to form wide suction port and flow path of the impeller, floating objects are not caught on the spiral blade even when the floating objects flow into the duct member. Moreover, even when string or the like flows into the duct member, the string does not wind itself around the long blade face of the spiral blade. As a result, the suction performance is improved.

A water jet propulsion type outboard motor according to a second aspect of the present invention is the outboard motor of the first aspect, wherein the outboard motor further includes a cooling water system for cooling the power source, including: a pump for pumping up water from outside; first and second water channel systems for guiding water from outside into the pump; and a third water channel system from the pump via the power source to the outside.

A water jet propulsion type outboard motor according to a third aspect of the present invention is the outboard motor according to the second aspect, wherein the first water channel system includes: a water suction port provided on an inner surface of the duct member between the impeller and the discharge port; a straight tubular path having the water intake port on its end, penetrating through the duct member; a first water channel branching from the straight tubular path, for guiding water into the pump; and a strainer provided in the straight tubular path so as to be detachable from the outside, and wherein the second water channel system includes: a water intake unit for taking in water from outside; and a second water channel for guiding water from the water intake unit into the pump.

In the above structure, the cooling water system for cooling the power source includes two water channel systems for guiding cooling water into the pump, that is, the first and second water channel systems. The first water channel system takes water in through the water intake port provided on the inner wall of the duct member between the impeller and the discharge port, whereas the second water channel system takes water in from outside. During the normal running of the ship, water pressure within the duct member between the impeller and the discharge port is increased by the rotation of the impeller. Thus, the cooling water is mainly taken from the water intake port of the first water channel system. During the running of the ship in shallows, even when sand or the like is sucked into the duct member so as to cause clogging of the strainer provided for the straight tubular path extending from the water intake port, making it difficult to take water in through the water intake port of the first water channel system, water is continuously supplied to the cooling water system because the pump takes water in from the water intake unit of the second water channel system instead. Thus, the burning out of the power source can be prevented.

Moreover, since the strainer is provided in the straight tubular path penetrating through the duct member, the strainer is detachable from outside.

A water jet propulsion type outboard motor according to a fourth aspect of the present invention is the outboard motor of the second aspect, wherein the outboard motor includes a water supply port for supplying running water to the first and second water channel systems.

In the above structure, water can be supplied from the water supply port to the first and second water channel systems. Therefore, when the running water is connected to the water supply port during washing operation on land, running water can be easily supplied to the cooling water system to wash the power source of the cooling water system (for removal of a salt content, mud, sand or the like) and to cool the bearings of the impeller.

A water jet propulsion type outboard motor according to a fifth aspect of the present invention is the outboard motor of the third aspect, wherein the outboard motor propels with the water intake unit of the second water channel system being juxtaposed with the inlet port of the duct member.

In the above structure, since the water intake unit is juxtaposed with the suction port, the water intake unit is not affected by the suction of sand or the like into the duct member during the running of a ship.

A water jet propulsion type outboard motor according to a sixth aspect of the present invention is the outboard motor of the third aspect, wherein the water intake unit of the second water channel system comprises an expanded water channel wider than the second water channel.

In the above structure, since the water intake unit has an expanded water channel which is wider than the second water channel, water flowing into the water intake unit circulates and is retained within the expanded water channel before it can be sucked into the second water channel. At this time, sand or the like mixed with the flowing water precipitate within the expanded water channel to be separated from the water.

A water jet propulsion type outboard motor according to a seventh aspect of the present invention is the outboard motor of the sixth aspect, wherein the water jet propulsion type outboard motor includes: an expanded water channel shell defining the expanded water channel; and a flat plate protruding outward from the expanded water channel shell, wherein the outboard motor propels with the flat plate being provided horizontally in the vicinity of the water surface.

In the above structure, since the flat plate protrudes outward from the expanded water channel shell and is horizontally provided in the vicinity of the water surface, the flat plate blocks a flow of splashing water so as to prevent water from splashing into a ship. Moreover, the flat plate reduces a running resistance of the ship so as to prevent the running speed from being lowered.

A water jet propulsion type outboard motor according to an eighth aspect of the present invention is the outboard motor of the seventh aspect, the expanded water channel shell is provided with: a first opening for taking in water from outside; and a second opening communicated with the second water channel, wherein the outboard motor propels with the first opening being oriented downward.

In the above structure, since the first opening of the expanded water channel shell is oriented downward, debris or the like do not easily flow into the water intake unit while the ship is running.

A water jet propulsion type outboard motor according to a ninth aspect of the present invention is the outboard motor of the eighth aspect, wherein a strainer is attached over the first opening.

A water jet propulsion type outboard motor according to a tenth aspect of the present invention is the outboard motor of the eighth aspect, wherein the expanded water channel shell includes a pipe protruding inward provided on the second opening.

In the above structure, since a strainer is attached over the first opening, debris or the like is removed from water flowing into the water intake unit. Moreover, when a tip of the pipe protruding inward provided on the second opening of the expanded water channel shell is placed in a stagnant flow region within the expanded water channel, water without sand or the like can be efficiently taken in.

A water jet propulsion type outboard motor according to an eleventh aspect of the present invention is the outboard motor of the first aspect, wherein the outboard motor further includes an exhaust system for discharging exhaust gas from the power source to the outside, including: a first exhaust system provided within the housing, connected to the power source; and a second exhaust system for guiding exhaust gas to the outside, connected to the first exhaust system.

A water jet propulsion type outboard motor according to a twelfth aspect of the present invention is the outboard motor of the eleventh aspect, wherein the second exhaust system includes: an exhaust path provided around a surrounding wall of the duct member, connected to the first exhaust system; and an exhaust port in the vicinity of the discharge port of the duct member, wherein the outboard motor propels with the exhaust port being provided under the discharge port.

In the above structure, since the exhaust port is open in the vicinity of a lower side of the discharge port, the exhaust gas from the power source is released under water. A pressure fluctuation of the exhaust gas (exhaust noise wave) of the power source is dissipated so as to be attenuated while the exhaust gas is passing through the water. Therefore, exhaust noise of the power source is reduced.

A water jet propulsion type outboard motor according to a thirteenth aspect of the present invention is the outboard motor of the twelfth aspect, wherein the second exhaust system further includes a nozzle portion connected from the exhaust path to the exhaust port along the duct member, and wherein the outboard motor propels with the nozzle portion being provided on a bottom of the duct member.

In the above structure, since the nozzle portion is provided along the bottom of the duct member, the side slipping of a ship is prevented, thus enhancing the straight running ability of the ship.

A water jet propulsion type outboard motor according to a fourteenth aspect of the present invention is the outboard motor of the eleventh aspect, wherein the second exhaust system includes: a plurality of expansion chambers connected to the first exhaust system; and an exhaust pipe connected to the expansion chamber, for discharging exhaust gas to the outside.

In the above structure, when exhaust gas from the power source successively flows into a plurality of expansion chambers to be repeatedly expanded therein, and pressure fluctuation of the exhaust gas (exhaust noise wave) is gradually attenuated. Thus, exhaust noise of the power source is reduced.

A water jet propulsion type outboard motor according to a fifteenth aspect of the present invention is the outboard motor of the eleventh aspect, wherein the outboard motor further includes a cooling water system for cooling the power source, including: a water supply system for supplying water from outside into the power source; and a draining system for draining water from the power source to the outside, wherein the draining system and the exhaust system include a sump chamber for storing water from the draining system, and exhaust gas from the power source passes through the water stored in the sump chamber.

In the above structure, when the exhaust gas from the power source passes through the water stored in the sump chamber, pressure fluctuation of the exhaust gas (exhaust gas wave) of the engine is dissipated, so that in particular, higher harmonic waves (transmitting sound) is attenuated. Therefore, exhaust noise of the engine is reduced, and the operation noise is lowered.

A water jet propulsion type outboard motor according to a sixteenth aspect of the present invention is the outboard motor of the fifteenth aspect, wherein the water supply system is provided with a water supply port for supplying running water.

In the above structure, if running water is supplied from the water supply port, water can be stored in the sump chamber. Thus, similar sound deadening effects as those obtained during the running of the ship can be obtained even during the washing operation on land.

A water jet propulsion type outboard motor according to a seventeenth aspect of the present invention is the outboard motor of the first aspect, wherein the outboard motor further includes: a screen swingably supported on a peripheral of the suction port; a flexible lever connected with the screen; and an engaging slot to be removably engage with the lever; and wherein the outboard motor propels with the suction port of the duct member being oriented downward and a swing pivot of the screen being provided on a side of forward running.

In the above structure, when the lever is disengaged from the engaging slot so that the screen is separated from the suction port during the running of a ship, debris or the like caught on the screen can be swept away by a water flow caused by the running of the ship. If the lever is engaged with the engaging slot in a deflected state, the screen can be pushed against the inlet port to be attached thereon.

BEST MODE FOR CARRYING OUT THE INVENTION

Hereinafter, embodiments of the present invention will be described in detail with reference to the accompanying drawings. In the following description, the terms "forward" or "front" mean in a forward direction with respect to a running direction of a ship, and "rear", "backward" or "reverse" mean in a backward direction with respect to the running direction of the ship.

First Embodiment

Figure 1:
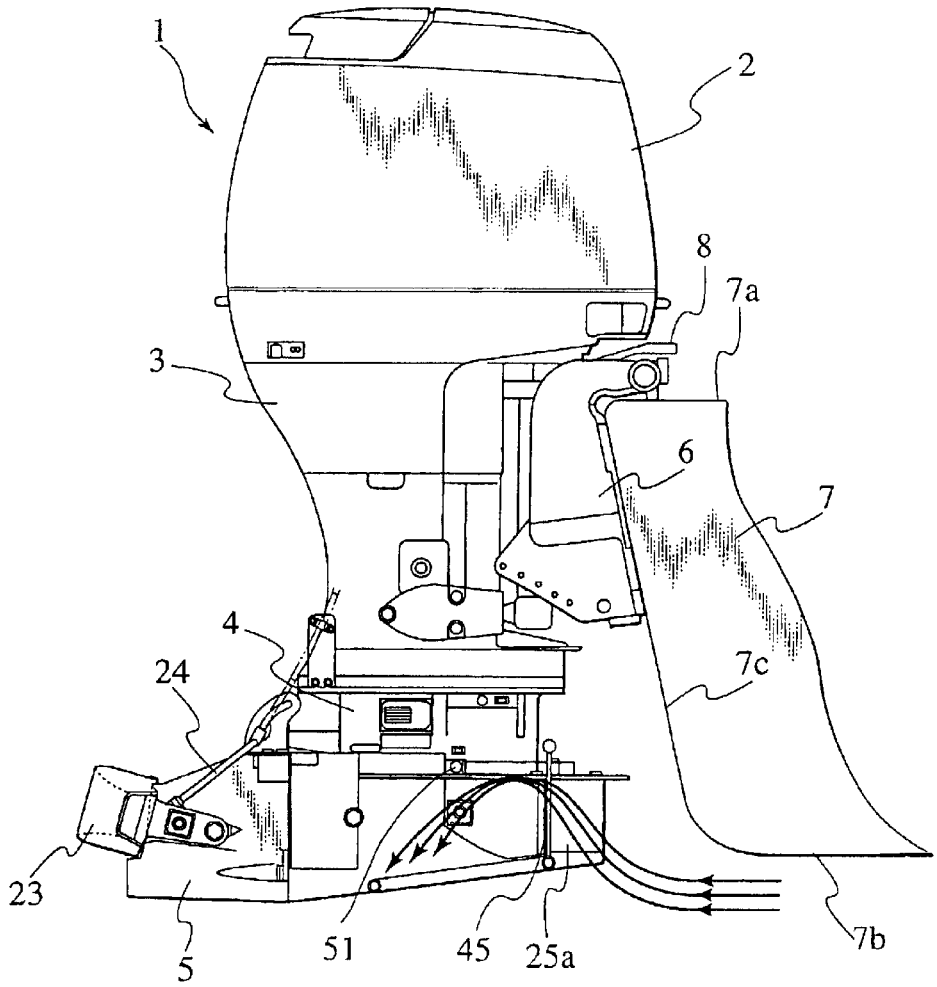
FIG. 1 is a side view showing a water jet propulsion type outboard motor according to a first embodiment of the present invention.

As shown in FIG. 1, an outboard motor 1 including an engine 2 serving as a power source, a housing 3 and a propulsion device 5, is removably attached to a transom 7*a* of a ship 7 through a bracket 6.

The engine 2 is mounted to the housing 3, and the propulsion device 5 is provided to an attachment frame 4 connected to the housing 3 in a hanging condition. The operation of the engine 2 and the steering are performed by an operation lever 8.

Figure 2:
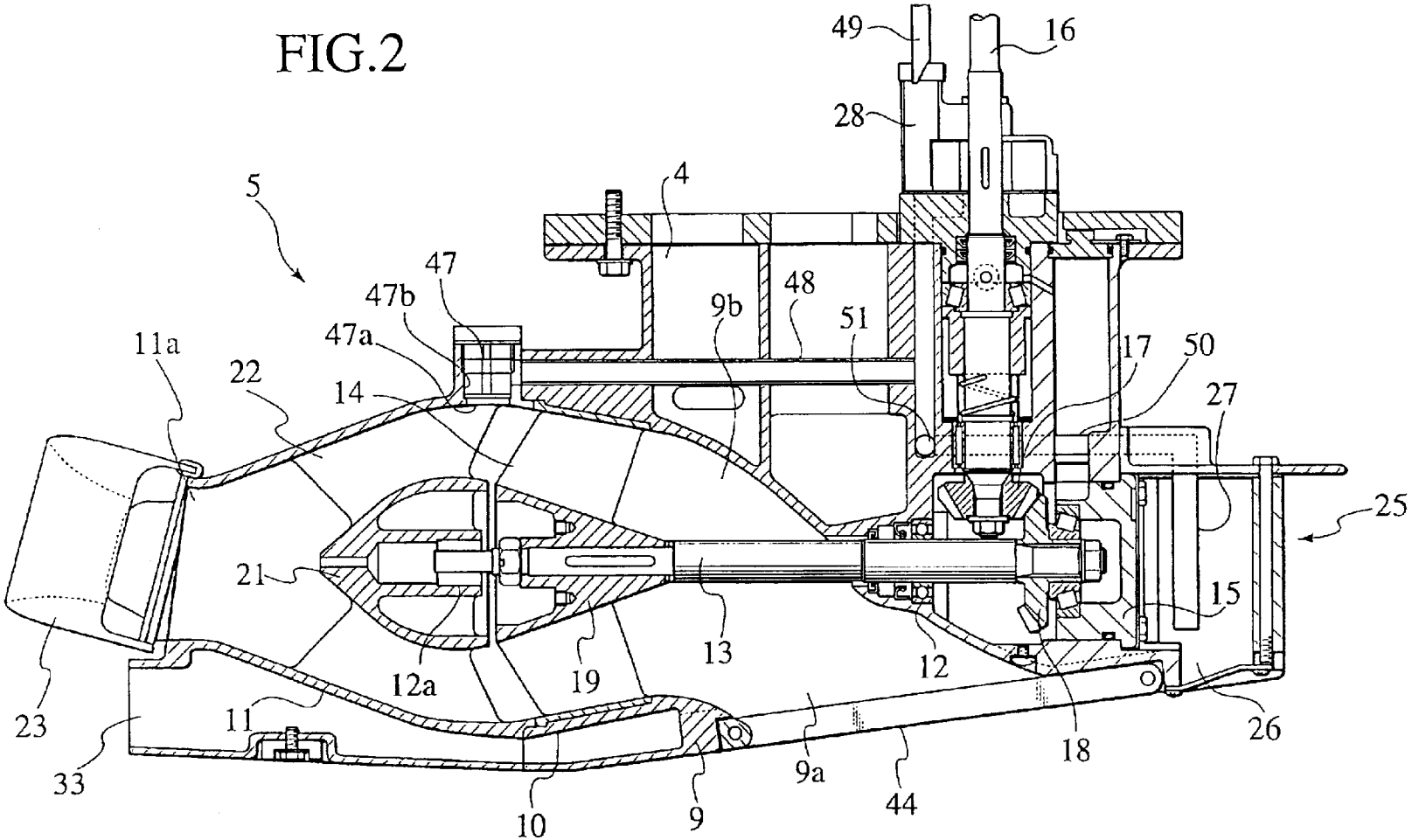
FIG. 2 is a longitudinal cross-sectional side view showing a propulsion device of the outboard motor of FIG. 1.
Figure 3:
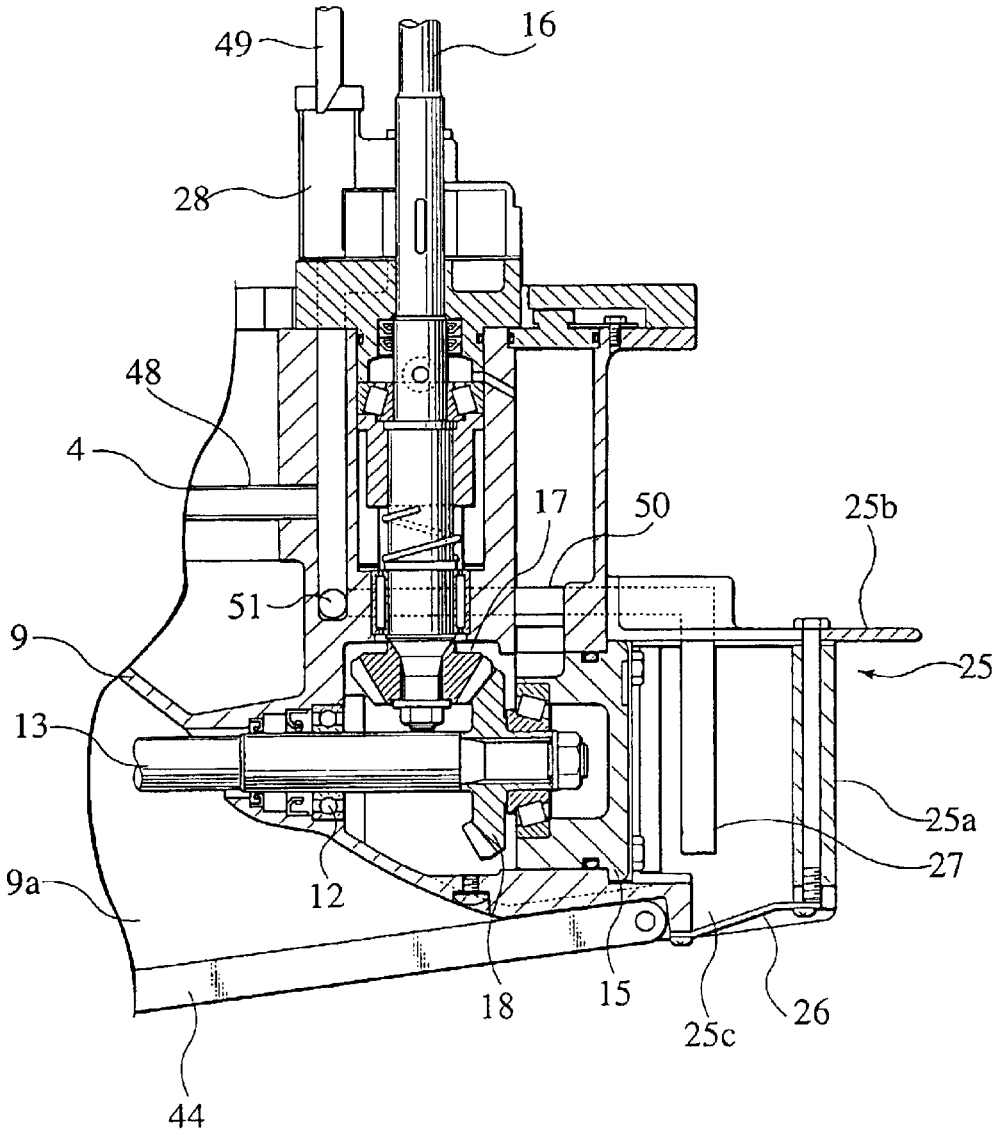
FIG. 3 is an enlarged view of a front part of the propulsion device of the outboard motor of FIG. 1.

As shown in FIG. 2 and FIG. 3, the propulsion device 5 includes a suction casing 9, a pump casing 10 and a discharge casing 11, which collectively serve as a duct member, a screen 44, an impeller 14, guide blades 22, and a reverser 23.

The suction casing 9 includes a suction port 9*a* in the vicinity of a bottom 7*b* under the water, forming a curved tubular short suction duct 9*b*. The pump casing 10 is provided so as to be connected to the rear of the suction casing 9, enclosing the impeller 14. The discharge casing 11 is provided so as to be connected into the pump casing 10 and has a discharge port 11*a* which is open in a backward direction.

The screen 44 is provided over the suction port 9*a* of the suction casing 9.

The impeller 14 is fixed to a rear end of an impeller shaft 13 that is rotatably supported by a bearing 12 provided on an upper wall of a forward part of the suction casing 9 so as to be approximately horizontal and is provided so as to extend into the pump casing 10.

A driving shaft 16 vertically extending from the engine 2 and the impeller shaft 13 which is provided approximately horizontal are inserted into a gear case 15 provided on the upper wall of the forward part of the suction casing 9. Then, a driving gear 17 fitted on a lower end of the driving shaft 16 and a driven gear 18 fitted on a forward end of the impeller shaft 13 mesh with each other within the gear case 15.

As a result, a driving power of the engine 2 is transmitted from the driving shaft 16 to the impeller shaft 13 to rotate the impeller 14.

Figure 4:
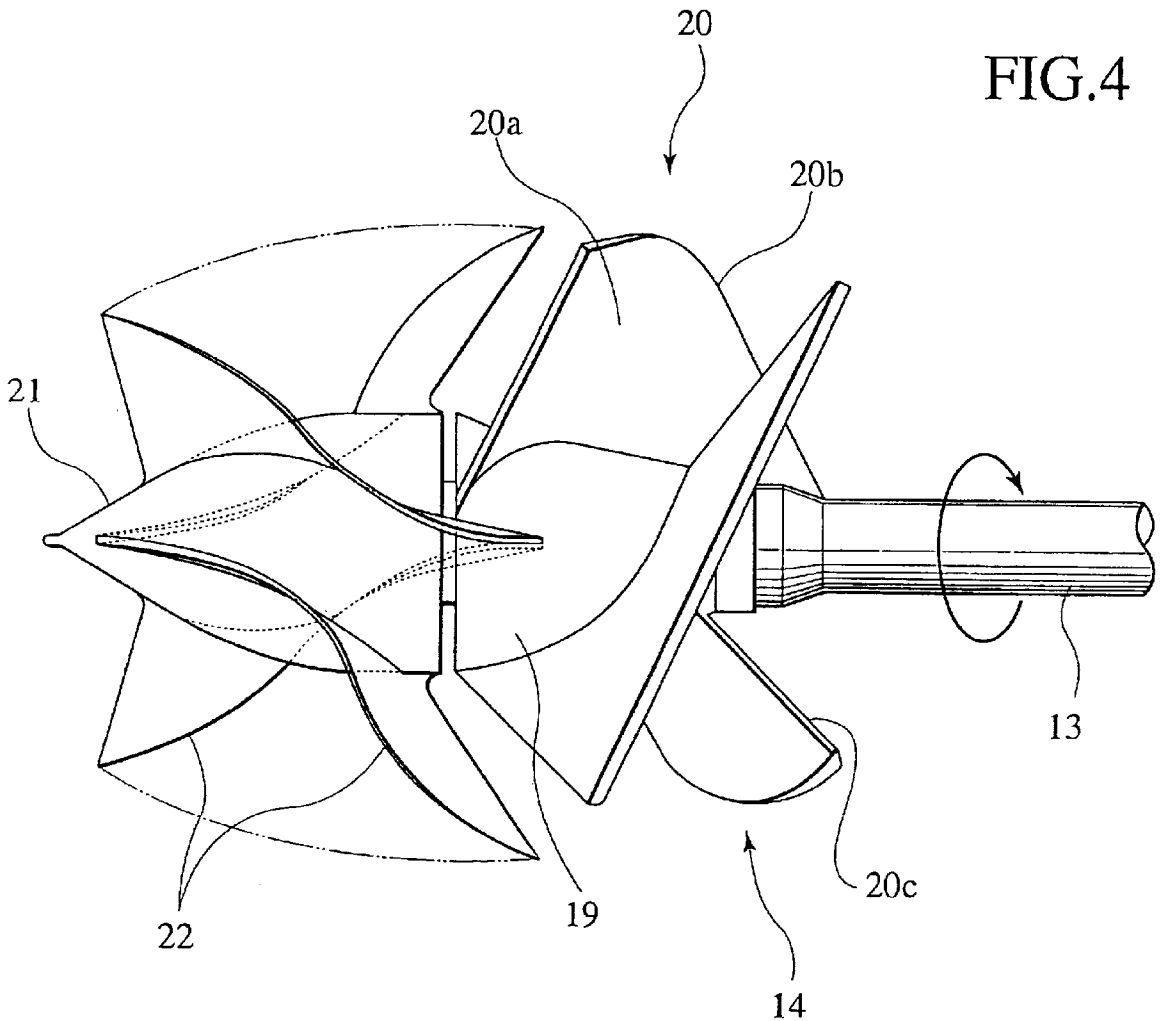
FIG. 4 is a side view of an impeller and guide blades of the outboard motor of FIG. 1.

The impeller 14 includes a hub 19 fixed to the impeller shaft 13 and a plurality of spiral blades 20 provided around the hub 19, as shown in FIG. 4. An outer peripheral edge 20*b* of the spiral blade 20 is close to an inner peripheral face of the pump casing 10 shown in FIG. 2. An outer peripheral distal end portion 20*c* of the spiral blade 20 extends to a rear end of the suction duct 9*b* of the suction casing 9, forming a long blade face 20*a* of the impeller 14.

A plurality of guide blades 22 are provided around a blade boss 21 in which a bearing 12*a* supporting a rear end of the blade shaft 13 is provided. The guide blades 22 are connected to an inner surface of the discharge casing 11. The guide blades 22, the blade boss 21 and the discharge casing 11 form a plurality of ducts for straightening a swirl flow which is pressurized and accelerated with the impeller 14 into a linear flow. The blade boss 21, the hub 19, and the pump casing 10 and the discharge casing 11 constituting a barrel-shaped duct member, together define a curved flow path.

The reverser 23 for reverse running is provided behind the discharge casing 11. When the reverser 23 is vertically rotated by the operation lever 24 shown in FIG. 1, the reverser 23 covers the discharge port 11*a* to reverse a water jet flow jetted out from the discharge port 11*a*. As a result, the ship 7 runs in reverse.

Next, a cooling water system for cooling the engine 2 of the outboard motor 1 will be described with reference to FIG. 1 to FIG. 6.

The cooling water system for cooling the engine 2 of the outboard motor 1 includes a cooling water pump 28 for pumping up water from outside of the outboard motor 1, a first water channel system and a second water channel system for guiding cooling water from outside of the outboard motor 1 to the cooling water pump 28, and a third water channel system 49 for guiding water from the cooling water pump 28 via the engine 2 to outside of the outboard motor 1.

The first water channel system includes a water intake port 47*a*, a straight tubular path 47*b* having the water intake port 47*a* on one end, a cooling water pipe 48 serving as a first water channel, which branches from the straight tubular path 47*b* and guides water into the cooling water pump 28, and a strainer 47.

The water intake port 47*a* has an opening on an inner surface positioned above the bearing 12*a* of the impeller 14, behind the pump casing 10 and between the impeller 14 and the discharge port 11*a*. The strainer 47 is provided within the straight tubular path 47*b* penetrating through the pump casing 10.

The second water channel system includes an anti-splash box 25 serving as a water intake unit for taking in water from outside of the outboard motor 1, and a water channel 50 serving as a second water channel for guiding water from the anti-splash box 25 into the cooling water pump 28.

As shown in FIG. 1, a water supply port 51 is provided on the side of the propulsion device 5, and is connected to the first and second water channel systems.

The anti-splash box 25 is provided between the outboard motor 1 and the ship 7, and is attached fixedly so as to be juxtaposed with the suction port 9*a* in front of the gear case 15 provided on the upper wall of the forward part of the suction casing 9. The anti-splash box 25 includes a surrounding wall 25*a* serving as an expanded water channel shell, a brim-shaped manger board 25*b* (flat plate), a cooling water pipe 27 and a water intake 25*c*.

The surrounding wall 25*a* has a semicylindrical wall on the front side of the anti-splash box 25, forming an expanded water channel which is wider than the water channel 50 (a cross-sectional area of a duct of the expanded water channel corresponds to 20 to 30 times of that of the water channel 50).

Figure 5:
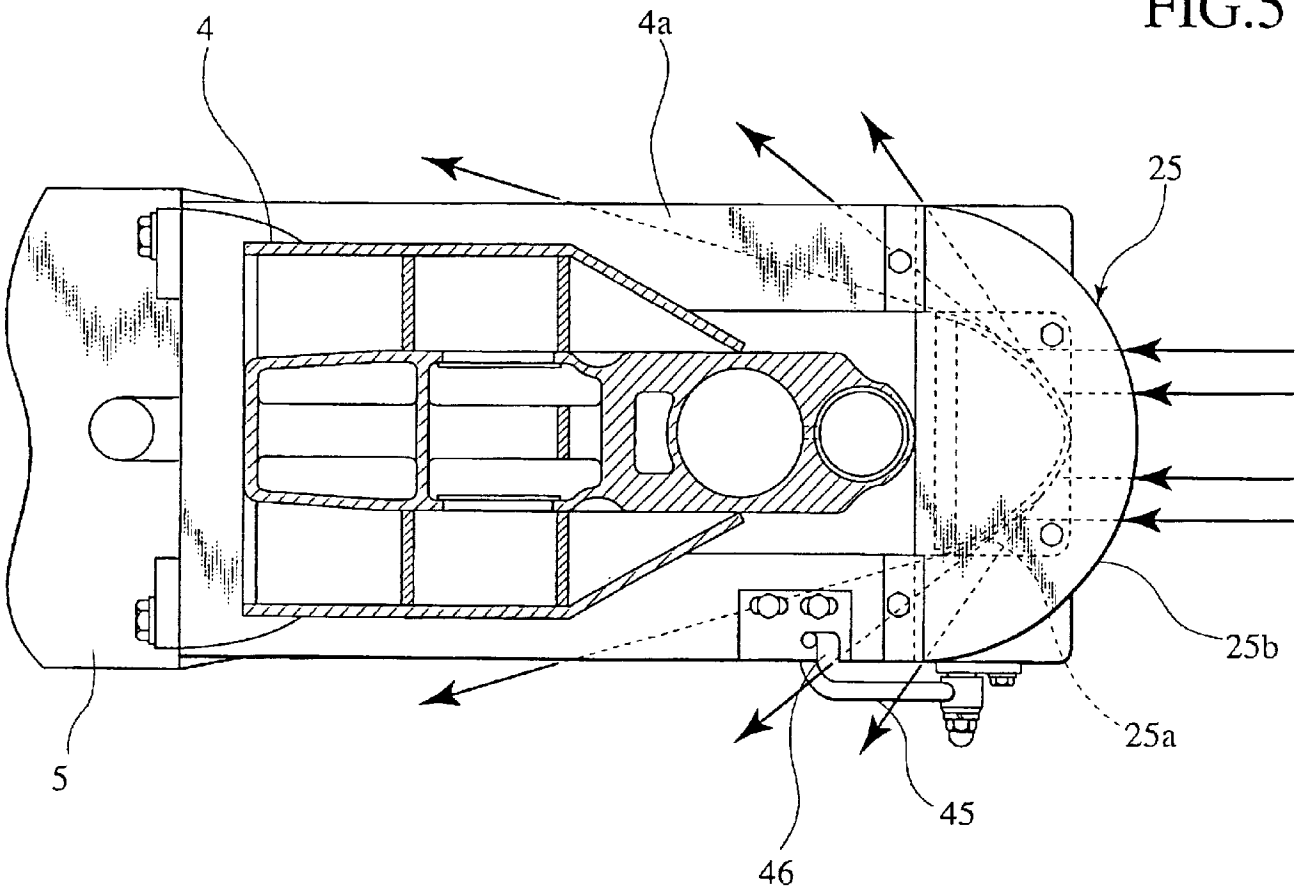
FIG. 5 is a plan view of the propulsion device showing a water flow around the outboard motor of FIG. 1.

The brim-shaped manger board 25*b* is attached fixedly to the anti-splash box 25 and protrudes over the forward to side parts of the surrounding wall 25*a* to be connected to a flange 4*a* of the attachment frame 4 of the propulsion device 5, as shown in FIG. 5.

Figure 6:
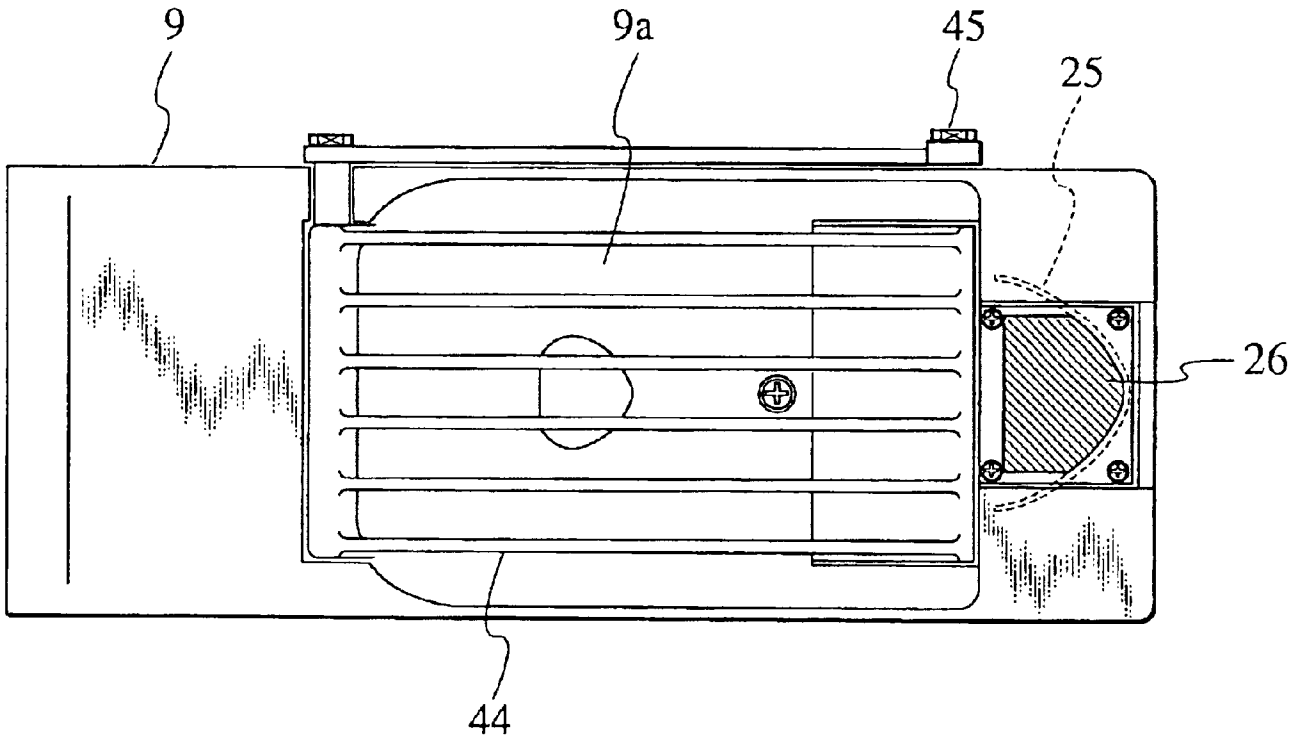
FIG. 6 is a bottom view showing a suction casing of the propulsion device of the outboard motor of FIG. 1.

As shown in FIG. 6, the water intake 25*c* is open on the bottom of the anti-splash box 25 in a downward direction. The strainer 26 is attached over the water intake 25*c*.

The cooling water pipe 27 is vertically arranged to extend inward from the upper wall of the anti-splash box 25 and connected to the cooling water pump 28 of the engine 2.

Next, the exhaust system for discharging exhaust gas from the engine 2 of the outboard motor 1 to outside will be described based on FIG. 7 and FIG. 8.

Figure 7:
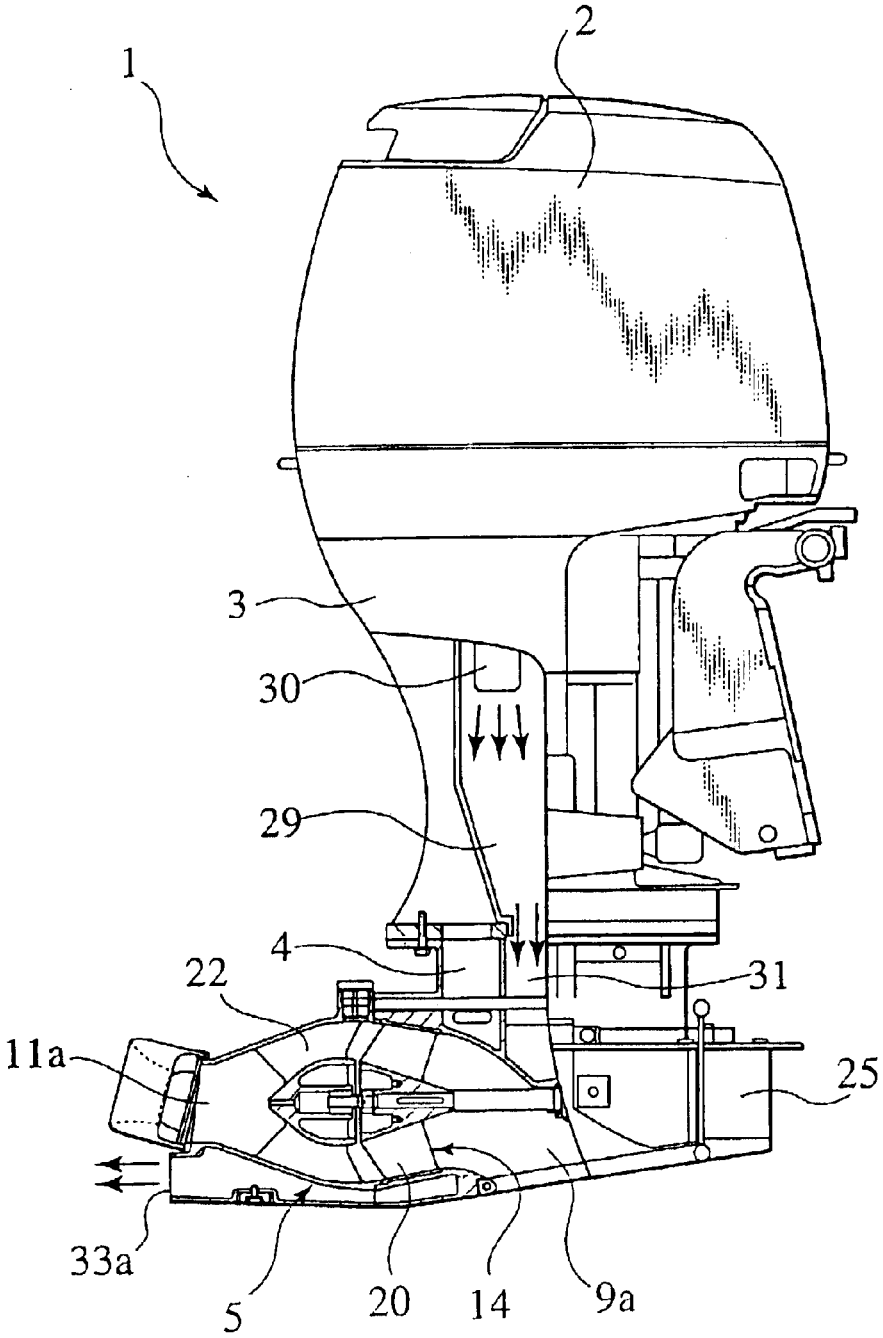
FIG. 7 is a partial longitudinal cross-sectional side view of the outboard motor, showing an exhaust system of the outboard motor of FIG. 1.
Figure 8:
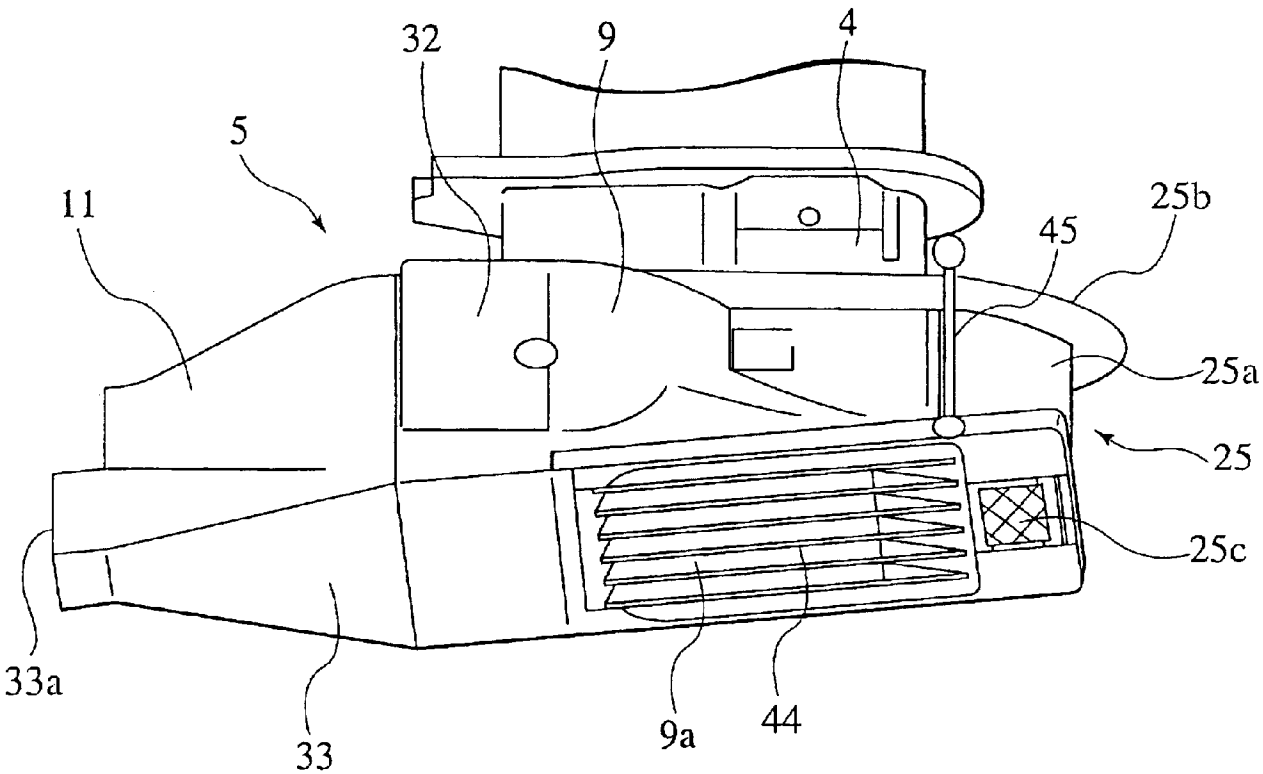
FIG. 8 is a perspective view showing the propulsion device of the outboard motor of FIG. 1.

As shown in FIG. 7 and FIG. 8, the exhaust system for discharging exhaust gas from the engine 2 to outside includes: an exhaust chamber 29 serving as a first exhaust system; an exhaust duct 31 serving as a second exhaust system connected to the exhaust chamber 29, for guiding exhaust gas to outside; and an exhaust path 32; a nozzle portion 33; and an exhaust port 33*a*.

The exhaust chamber 29 is provided within the housing 3, and is connected to the engine 2. In the exhaust chamber 29, an exhaust cylinder 30 of the engine 2 is vertically provided in a hanging state.

The exhaust duct 31 is provided for the attachment frame 4, and is connected to the bottom of the exhaust chamber 29.

The exhaust path 32 is connected to the exhaust duct 31, and is provided around the surrounding wall of the suction casing 9.

The nozzle portion 33 is connected to the exhaust path 32 along the bottom of the discharge casing 11, and is provided so as not to protrude downward beyond the inlet port 9*a* of the suction casing 9.

The exhaust port 33*a* facing backward is opened in the vicinity of a lower side of the discharge port 11*a* of the discharge casing 11.

According to the first embodiment, since the suction port 9*a* of the suction casing 9 is open in the vicinity of the bottom 7*b* of the ship, the propulsion device 5 does not protrude downward beyond the bottom 7*b*. Moreover, since the impeller 14 is enclosed within the casing of the propulsion device 5, the impeller 14 does not come into contact with obstacles such as sand or rocks. Therefore, the propulsion device 5 and the impeller 14 are not easily damaged, thereby providing safe running of a ship even in shallows such as in the vicinity of a shoreline or on a river.

Since the suction casing 9 forms the curved tubular short suction duct 9*b*, the propulsion device 5 is reduced in length, thereby reducing the outboard motor 1 in weight. Moreover, since the propulsion device 5 has a small length and therefore does not protrudes backward from the ship 7, the amount of band-shaped objects that wind themselves around the propulsion device 5 or the contact with the driftwood or the like is decreased, thereby increasing the working rate of the outboard motor 1.

Furthermore, since the outer peripheral edge 20*b* of the spiral blade 20 is close to the inner peripheral face of the pump casing 10 to give an axially symmetrical energy to a fluid in a cross section vertical to a rotation axis of the impeller 14, balance efficiency is improved. Moreover, the outer peripheral distal end portion 20*c* of the spiral blade 20 extends to the rear end of the suction duct 9*b* of the suction casing 9 to form wide suction port and flow path of the impeller 14, floating objects are not caught on the spiral blade 20 even when the floating objects flow into the suction casing 9. Moreover, even when strings or the like flows into the suction casing 9, the strings does not wind itself around the long blade face 20*a* of the spiral blade 20. As a result, the suction performance is improved.

The cooling water system for cooling the engine 2 of the outboard motor 1 includes two water channel systems for guiding cooling water into the cooling water pump 28, that is, the first and second water channel systems. The first water channel system takes water in through the water intake port 47*a* having an opening on the inner wall between the impeller 14 in the rear of the pump casing 10 and the discharge port 11*a*, whereas the second water channel system takes water in from the anti-splash box 25 attached fixedly so as to be juxtaposed with the suction port 9*a* in the forward part of the suction casing 9. During the normal running of the ship 7, a water pressure in the rear part of the pump casing 10 is increased by the rotation of the impeller 14. Thus, the cooling water for the engine 2 is mainly taken in from the water intake port 47*a* of the first water channel system. During running of the ship 7 in shallows, even when sand or the like is sucked into the suction casing 9 so as to cause clogging of the strainer 47 provided over the straight tubular path 47*b* extending from the water intake port 47*a*, making it difficult to take in water through the water intake port 47*a* of the first water channel system, water is continuously supplied to the cooling water system because the cooling water pump 28 takes in water from the anti-splash box of the second water channel system instead. Thus, the burning out of the engine 2 can be prevented.

Since the strainer 47 is provided over the straight tubular path 47*b* penetrating through the wall of the pump casing 10, the strainer 47 can be attached and removed from outside of the pump casing 10.

Since the anti-splash box 25 is attached fixedly so as to be juxtaposed with the suction port 9*a* in front of the suction casing 9, the anti-splash box 25 is not affected by suction of sand or the like into the suction casing 9 during the running of the ship 7. Moreover, since the water intake 25*c* is open in a downward direction on the bottom of the anti-splash box 25, debris or the like hardly flows in through the water intake 25*c* while the ship 7 is running.

Since the strainer 26 is provided over the water intake 25*c*, debris or the like is removed from water flowing into the anti-splash box 25. Furthermore, since the surrounding wall 25*a* of the anti-splash box 25 forms the expanded water channel which is wider than the water channel 50 of the second water channel system, the water flowing into the anti-splash box 25 circulates and is retained within the anti-splash box 25 before being sucked into the water channel 50. At this time, sand or the like mixed in with the flowing water precipitates within the anti-splash box 25 so as to be separated from the water. When the tip of the cooling water pipe 27 vertically arranged to extend inward from the upper wall of the anti-splash box 25 is placed in a stagnant flow region within the anti-splash box 25, the water without sand or the like can be efficiently taken.

The water supply port 51 is provided on the side of the propulsion device 5, connected to the first and second water channel systems. Therefore, when running water is connected to the water supply port 51 during a washing operation on land, the running water can be easily supplied to the cooling water system to wash the engine 2 of the cooling water system (for removal of a salt content, mud, sand or the like) and to cool the bearing 12*a* of the impeller 14.

Since the surrounding wall 25*a* of the anti-splash box 25 has a semicylindrical wall on the front side of the anti-splash box 25, water flow splashing from the stern 7*c* during the running of the ship 7 to strike against the surrounding wall 25*a* is pushed away to rear (an arrow in FIG. 5 indicates a water flow). The brim-shaped manger board 25*b* protrudes over the forward to the side parts of the surrounding wall 25*a* and is connected to the flange 4*a* of the attachment frame 4 of the propulsion device 5 to be horizontally provided in the vicinity of the water surface. Therefore, the manger board 25*b* blocks the flow of splashing water (arrows in FIG. 1 indicates a water flow) so as to prevent water from splashing into the propulsion device 5 and the ship. Moreover, the manger board 25*b* reduces the running resistance of the ship to prevent the running speed from being lowered.

The exhaust system includes the exhaust chamber 29, the exhaust duct 31, the exhaust path 32, the nozzle portion 33 and the exhaust port 33*a*, which are in successive connection with each other from the engine 2. An exhaust gas from the engine 2 passes through them to be discharged to outside.

Since the exhaust cylinder 30 of the engine 2 vertically provided in a hanging state within the exhaust chamber 29, pressure fluctuation of the exhaust gas from the engine 2 (exhaust noise wave) is attenuated while the exhaust gas is flowing from the exhaust cylinder 30 into the exhaust chamber 29 to be expanded. Therefore, exhaust noise of the engine 2 is reduced.

Since the nozzle portion 33 is provided along the bottom of the discharge casing 11 so as not to protrude downward beyond the suction port 9*a* of the suction casing 9, the nozzle portion 33 does not generate any water flow resistance during the running of the ship 7. Moreover, the side slipping is prevented, thus enhancing the straight running ability of the ship 7.

Since the exhaust port 33*a* facing backward is opened in the vicinity of the lower side of the discharge port 11*a* of the discharge casing 11, exhaust gas from the engine 2 is discharged under the water. As a result, pressure fluctuation of the exhaust gas from the engine 2 (exhaust noise wave) is dissipated and attenuated while the exhaust gas is passing through the water. Therefore, exhaust noise of the engine 2 is reduced. The released exhaust gas does not adversely affect the running of the ship 7.

Second Embodiment

Next, the second embodiment with another exhaust system will be described based on FIG. 9 and FIG. 10. The same elements as those in the first embodiment are denoted by the same reference numerals, and description thereof is omitted.

Figure 9:
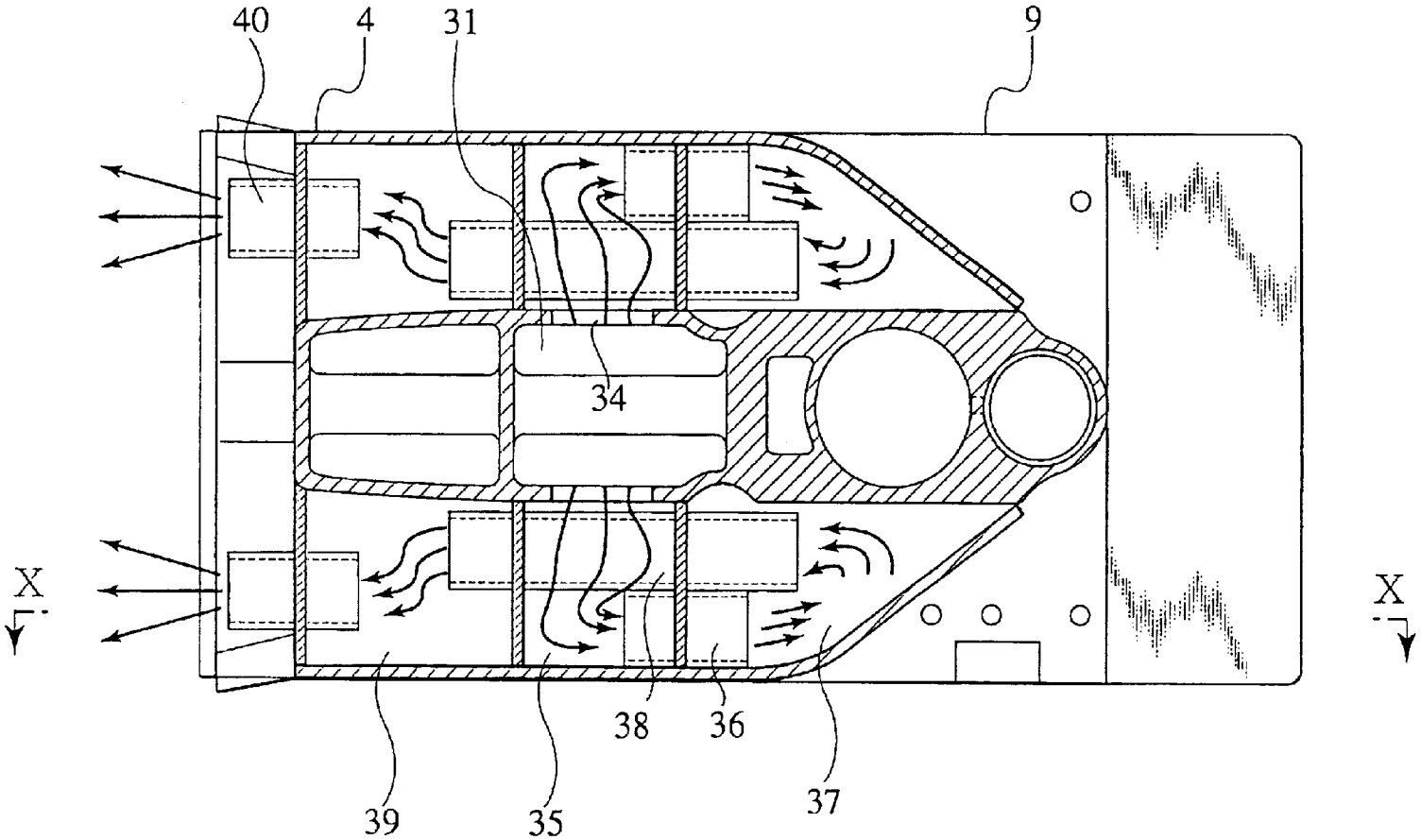
FIG. 9 is a plan view of expansion chambers provided for an attachment frame, constituting a part of an exhaust system of a water jet propulsion type outboard motor according to a second embodiment of the present invention.
Figure 10:
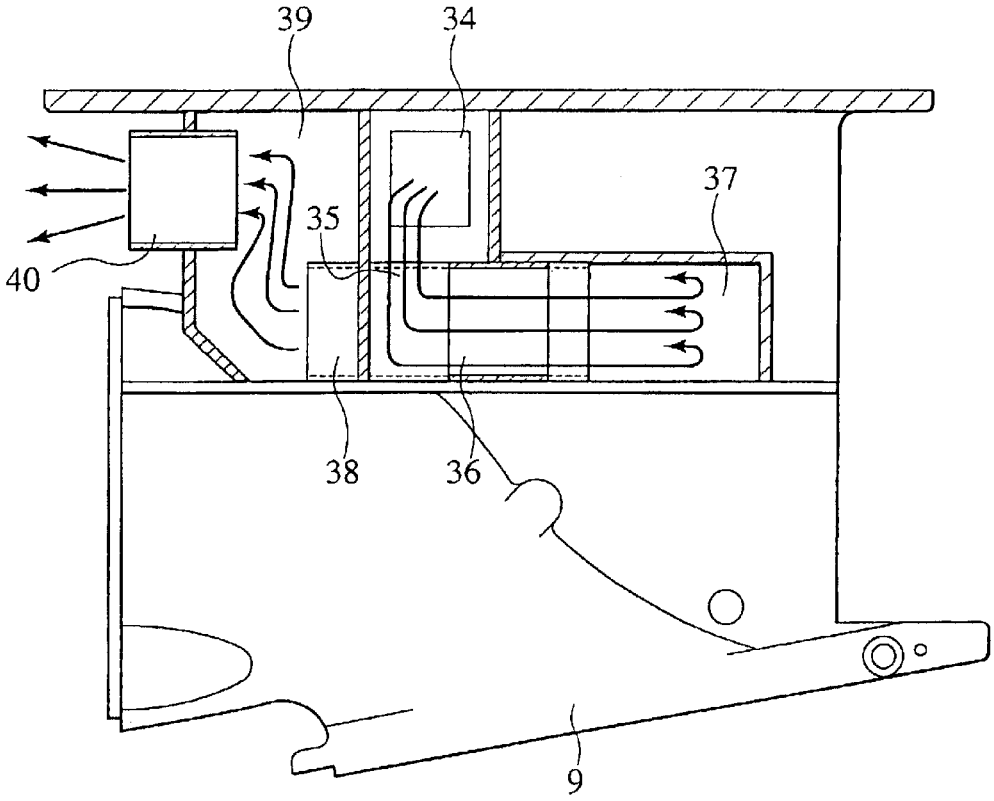
FIG. 10 is a partial longitudinal cross-sectional side view of a propulsion device showing the expansion chambers, viewed from a plane cut along the X—X line in FIG. 9.

As shown in FIG. 9 and FIG. 10, a first expansion chamber 35, a second expansion chamber 37 and a third expansion chamber 39 are provided within the attachment frame 4.

The first expansion chamber 35 is connected to the exhaust duct 31 through the exhaust port 34.

The second expansion chamber 37 is connected to the first expansion chamber 35 through a first connection pipe 36.

The third expansion chamber 39 is connected to the second expansion chamber 37 through a second connection pipe 38.

An exhaust pipe 40, connected to the third expansion chamber 39, is open in a rear direction of the attachment frame 4 so as to discharge exhaust gas into the atmosphere or the water.

According to the second embodiment, exhaust gas from the engine 2 in FIG. 1 passes from the exhaust duct 31 through the exhaust port 34 to the first exhaust chamber 35, then, through the first connection pipe 36 to the second expansion chamber 37, and through the second connection pipe 38 to the third expansion chamber 39 in a successive manner.

As a result, pressure fluctuation of the exhaust gas from the engine 2 (exhaust noise wave) is attenuated while the exhaust gas is flowing into the first expansion chamber 35 to be expanded. Thereafter, the exhaust gas is repeatedly expanded while successively flowing into the second expansion chamber 37 and further the third expansion chamber 39, so that pressure fluctuation is further attenuated. Thus, exhaust noise of the engine 2 is reduced.

Furthermore, since the first through third expansion chambers serving as sound deadening devices are housed within the attachment frame 4, the outboard motor 1 can be compact.

Third Embodiment

Next, the third embodiment with another draining system and another exhaust system will be described based on FIG. 11 and FIG. 12. The same elements as those in the first embodiment are denoted by the same reference numerals, and description thereof is omitted.

Figure 11:
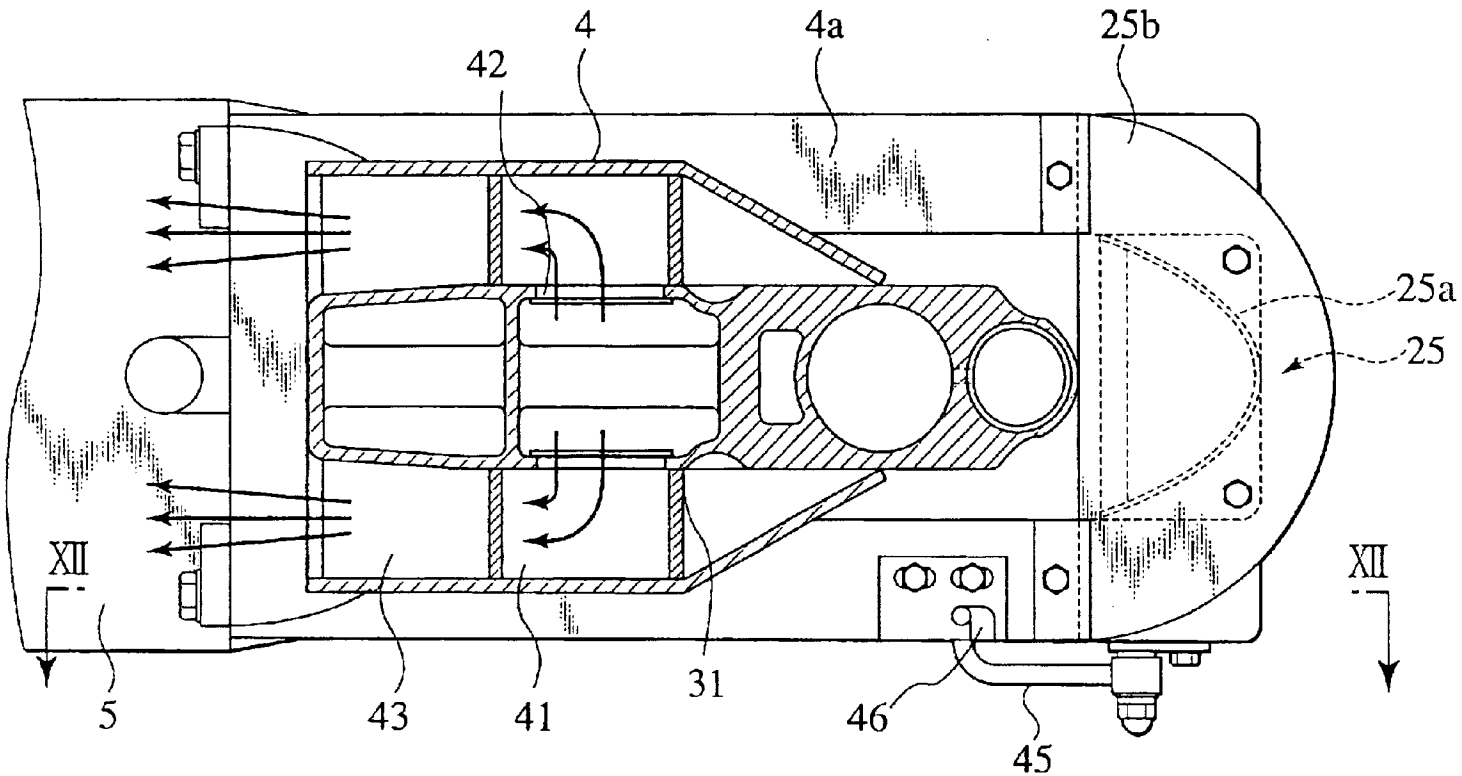
FIG. 11 is a plan view showing a sump chamber provided for the attachment frame, which constitutes a part of the draining system and the exhaust system of a water jet propulsion type outboard motor according to a third embodiment of the present invention.
Figure 12:
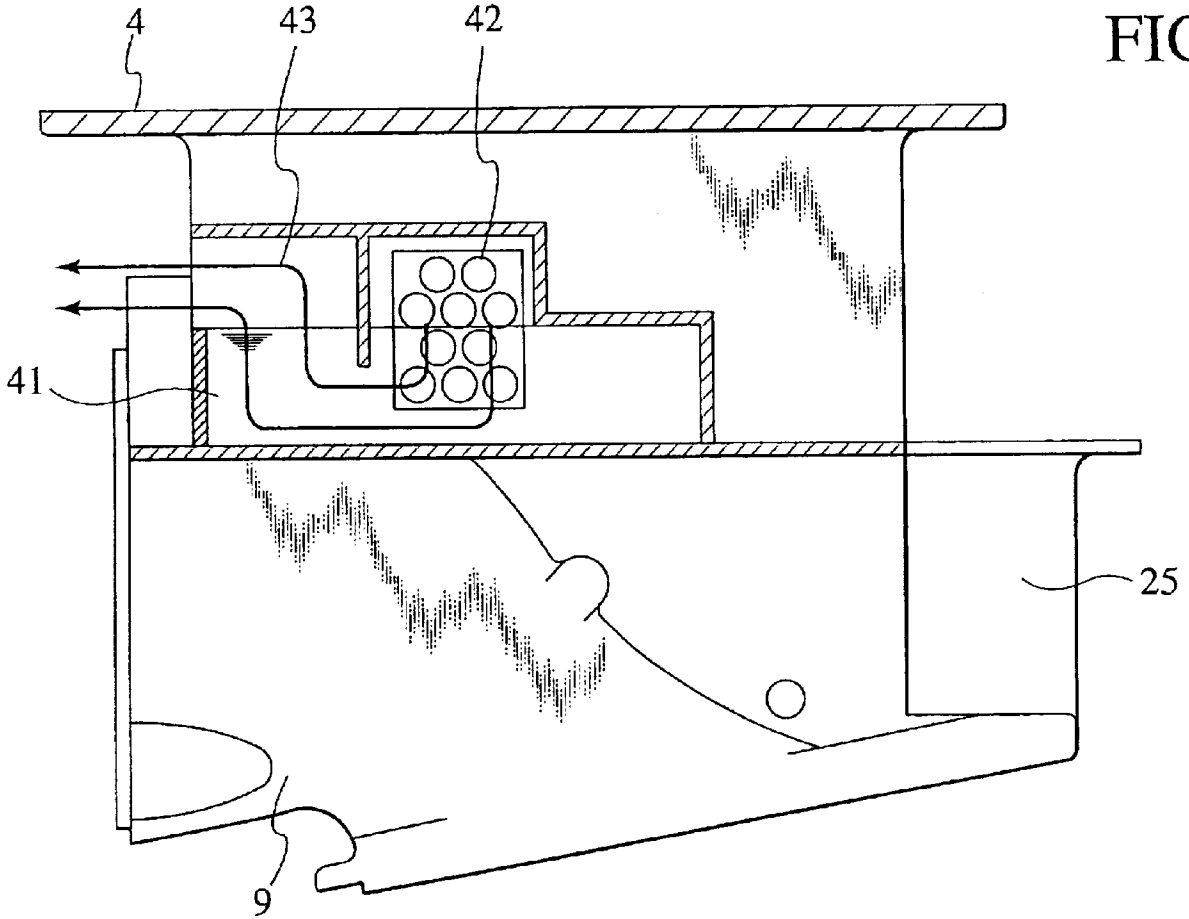
FIG. 12 is a partial longitudinal cross-sectional side view of a propulsion device showing the sump chamber, viewed from a plane cut along the XII—XII line in FIG. 11.

As shown in FIG. 11 and FIG. 12, a sump chamber 41 is provided within the attachment frame 4.

The sump chamber 41 serves as a part of a draining system for draining the cooling water from the engine 2 shown in FIG. 1 to outside. At the same time, the sump chamber 41 also serves as a part of an exhaust system for discharging exhaust gas from the engine 2 to outside. Specifically, drain water of the cooling water flows down to be stored in the sump chamber 41 while the exhaust gas from the engine 2 passes through the sump chamber 41.

A perforated plate 42 is attached on a partition wall between the exhaust duct 31 and the sump chamber 41.

An exhaust path 43, connected to the sump chamber 41, has an opening in a rearward direction of the attachment frame 4 so as to discharge exhaust gas into the atmosphere or under the water.

According to the third embodiment, the exhaust gas from the engine 2 whose noise is attenuated in the exhaust chamber 29 shown in FIG. 7 passes from the exhaust duct 31 provided for the attachment frame 4 through the perforated plate 42 to flow into the sump chamber 41 so as to pass through the drain water stored in the sump chamber 41. A pressure fluctuation of the exhaust gas (exhaust noise wave) of the engine 2 is dissipated so that, in particular, higher harmonic waves (transmitted sound) are attenuated while the exhaust gas is passing through the drain water. Therefore, exhaust noise of the engine 2 is reduced and the operation noise is lowered.

Furthermore, if running water is supplied through the water supply port 51 shown in FIG. 1, drain water can be stored in the sump chamber 41. In this manner, similar sound deadening effects as those obtained during the running of a ship can be obtained even during a washing operation on land.

Next, the screen 44 in the first to third embodiments will be described based on FIG. 5 and FIG. 13.

Figure 13:
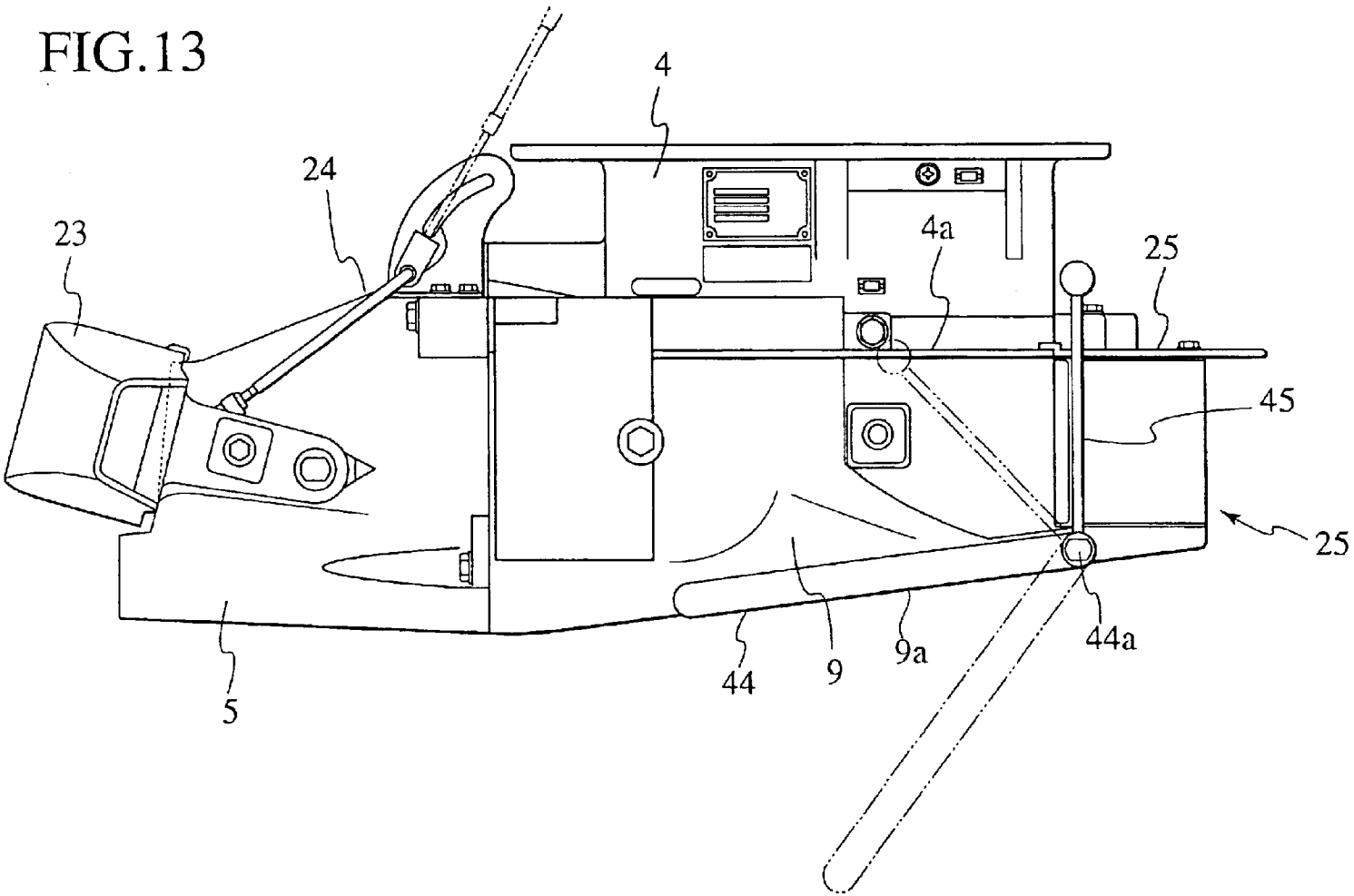
FIG. 13 is a side view of a propulsion device, showing a screen provided over an inlet port of a water jet propulsion outboard motor according to the first to third embodiments.

As shown in FIG. 13, the screen 44 is hinged on the suction port 9*a* of the suction casing 9. A base end portion 44*a* of the screen 44 is swingably supported on a forward peripheral edge of the suction port 9*a*.

A flexible lever 45 is connected to the base end portion 44*a* of the screen 44 and is removably engaged with an engaging slot 46 provided on the flange 4*a* extending from the bottom of the attachment frame 4 in FIG. 5 toward the side.

The engaging slot 46 has a slot formed so that the lever 45 can be engaged therewith in a deflected state.

As a result, the screen 44 is pushed against the peripheral edge of the suction port 9*a* of the suction casing 9 so as to be attached thereon.

Moreover, when the lever 45 is removed from the engaging slot 46 so that the screen 44 is separated from the suction port 9*a* of the suction casing 9 during the running of the ship 7, debris or the like caught on the screen 44 can be swept away with a water flow. When the open/close lever 45 is deflected be engaged with the engaging slot 46, the screen 44 is pushed against the suction port 9*a* to be attached thereon. As a result, the functions of the screen 44 are recovered.

With the above mechanism, a conventional fixed type screen can be made movable in order to easily remove the debris or the like caught on the screen.

INDUSTRIAL APPLICABILITY

As described above, according to a water jet propulsion type outboard motor of the present invention, the length of a propulsion device can be reduced, thereby reducing the outboard motor in size as well as weight. Moreover, since an impeller is enclosed within a duct member, a ship can run safely even in shallows such as in the vicinity of a shoreline or on a river. Furthermore, spiral blades improve balance efficiency and suction performance of the impeller in order to obtain high thrust. A water intake unit for cooling water with an expanded water channel can prevent sand or the like from getting mixed in with cooling water. Since a front part of an expanded water channel shell defining the expanded water channel is formed to have a semicylindrical shape and a flat plate protruding therefrom is horizontally provided in the vicinity of a water surface in front of the propulsion device, increase in running resistance due to collision of water flow and water splash into a ship can be prevented. An exhaust system, which guides the exhaust gas from a power source into the water under a discharge port of the duct member or into drain water in a sump chamber within an attachment frame, reduces the exhaust noise to a lower operation noise. When a swingable screen, to which a flexible lever is connected, is opened and closed during the running of a ship, debris or the like caught on the screen can be easily removed by water flow caused by running. Therefore, the outboard motor according to the present invention is useful as a water jet propulsion type outboard motor.

What is claimed is:

1. A water jet propulsion type outboard motor comprising:

a power source;

a driving system for transmitting a driving power of the power source;

a curved tubular duct member fixed to a housing on which the power source is mounted, having a suction port and a discharge port;

guide blades provided within the duct member, in a vicinity of the discharge port thereof;

an impeller enclosed by the duct member and rotated by the driving system, wherein an outer peripheral edge of a spiral blade of the impeller provided around its hub is close to an inner peripheral face of the duct member, and its outer peripheral distal end portion extends toward the suction port; and a cooling water system for cooling the power source, including a pump for pumping up water from outside, first and second water channel systems for guiding water from outside into the pump, and a third water channel system for guiding water from the pump via the power source to the outside, wherein the first water channel system includes:

a water intake port provided on an inner surface of the duct member between the impeller and the discharge port;

a straight tubular path with the water intake port on its end, penetrating through the duct member;

a first water channel branching from the straight tubular path, for guiding water into the pump; and a strainer provided in the straight tubular path so as to be detachable from outside, and wherein the second water channel system includes:

a water intake unit for taking in water from outside; and a second water channel for guiding water from the water intake unit into the pump.

2. The water jet propulsion type outboard motor according to claim 1, further comprising an exhaust system for discharging exhaust gas from the power source to the outside, wherein the exhaust system includes:

a first exhaust system provided within the housing, connected to the power source; and a second exhaust system for guiding exhaust gas to outside, connected to the first exhaust system.

3. The water jet propulsion type outboard motor according to claim 2, wherein the second exhaust system includes:

a plurality of expansion chambers connected to the first exhaust system; and an exhaust pipe connected to the expansion chamber, for discharging exhaust gas to outside.

4. The water jet propulsion type outboard motor according to claim 1, further comprising:

a screen swingably supported on a peripheral of the suction port;

a flexible lever connected with the screen; and an engaging slot to be removably engaged with the lever, wherein the outboard motor propels with the suction port of the duct member being oriented downward and a swing pivot of the screen being provided on a forward running side.

5. A water jet propulsion type outboard motor comprising:

a power source;

a driving system for transmitting a driving power of the power source;

a curved tubular duct member fixed to a housing on which the power source is mounted, having a suction port and a discharge port;

guide blades provided within the duct member, in a vicinity of the discharge port thereof;

an impeller enclosed by the duct member and rotated by the driving system, wherein an outer peripheral edge of a spiral blade of the impeller provided around its hub is close to an inner peripheral face of the duct member, and its outer peripheral distal end portion extends toward the suction port; and a cooling water system for cooling the power source, including a pump for pumping up water from outside, first and second water channel systems for guiding water from outside into the pump, and a third water channel system for guiding water from the pump via the power source to the outside; and a water supply port for supplying running water to the first and second water channel systems of the cooling water system.

6. A water jet propulsion type outboard motor comprising:

a power source;

a driving system for transmitting a driving power of the power source;

a curved tubular duct member fixed to a housing on which the power source is mounted, having a suction port and a discharge port;

guide blades provided within the duct member, in a vicinity of the discharge port thereof; and an impeller enclosed by the duct member and rotated by the driving system, wherein an outer peripheral edge of a spiral blade of the impeller provided around its hub is close to an inner peripheral face of the duct member, and its outer peripheral distal end portion extends toward the suction port;

an exhaust system for discharging exhaust gas from the power source to the outside, wherein the exhaust system includes a first exhaust system provided within the housing, connected to the power source, and a second exhaust system for guiding exhaust gas to outside, connected to the first exhaust system;

wherein the second exhaust system includes:

an exhaust path provided around a surrounding wall of the duct member, connected to the first exhaust system; and an exhaust port in a vicinity of the discharge port of the duct member, wherein the outboard motor propels with the exhaust port being provided under the discharge port.

7. The water jet propulsion type outboard motor according to claim 6, wherein the second exhaust system further includes:

a nozzle portion connected from the exhaust path to the exhaust port along the duct member, wherein the outboard motor propels with the nozzle portion being provided on a bottom of the duct member.

8. A water jet propulsion type outboard motor comprising;

a power source;

a driving system for transmitting a driving power of the power source;

a curved tubular duct member fixed to a housing on which the power source is mounted, having a suction port and a discharge port;

guide blades provided within the duct member, in a vicinity of the discharge port thereof; and an impeller enclosed by the duct member and rotated by the driving system, wherein an outer peripheral edge of a spiral blade of the impeller provided around its hub is close to an inner peripheral face of the duct member, and its outer peripheral distal end portion extends toward the suction port;

an exhaust system for discharging exhaust gas from the power source to the outside, wherein the exhaust system includes a first exhaust system provided within the housing, connected to the power source, and a second exhaust system for guiding exhaust gas to outside, connected to the first exhaust system; and a cooling water system for cooling the power source, including:

a water supply system for supplying water from outside into the power source; and a draining system for draining water from the power source to the outside, wherein the draining system and the exhaust system include a sump chamber for storing water of the draining system, and exhaust gas from the power source passes through the water stored in the sump chamber.

9. The water jet propulsion type outboard motor according to claim 8, wherein the water supply system is provided with a water supply port for supplying running water.

10. A cooling water system for an outboard motor which has an impeller and a duct member enclosing the impeller, the system comprising:

a pump for pumping up water from outside;

first and second water channel systems for guiding water from outside into the pump; and a third water channel system for guiding water from the pump to the outside;

wherein the first water channel system includes;

a water intake port provided on an inner surface of the duct member;

a straight tubular path with the water intake port on its end, penetrating through the duct member;

a first water channel branching from the straight tubular path, for guiding water into the pump; and a strainer provided in the straight tubular path so as to be detachable from outside.

11. The cooling water system according to claim 10, wherein the second water channel system includes:

a water intake unit for taking in water from outside; and a second water channel for guiding water from the water intake unit into the pump.

12. The cooling water system according to claim 11, wherein the outboard motor propels with the water intake unit of the second water channel system being juxtaposed with a suction port of the duct member.

13. The cooling water system according to claim 11, wherein the water intake unit of the second water channel system comprises an expanded water channel wider than the second water channel.

14. The cooling water system according to claim 13, further comprising:

an expanded water channel shell defining the expanded water channel; and a flat plate protruding outward from the expanded water channel shell, wherein the outboard motor propels with the flat plate being provided horizontally in a vicinity of a water surface.

15. The cooling water system according to claim 14, wherein the expanded water channel shell is provided with:

a first opening for taking in water from outside; and a second opening communicated with the second water channel, wherein the outboard motor propels with the first opening being oriented downward.

16. The cooling water system according to claim 15, wherein a strainer is attached over the first opening.

17. The cooling water system according to claim 15, wherein the expanded water channel shell includes an inwardly protruding pipe provided on the second opening.

* * * * *

UNITED STATES PATENT AND TRADEMARK OFFICE

CERTIFICATE OF CORRECTION

PATENT NO. : 6,752,671 B2
DATED : June 22, 2004
INVENTOR(S) : E. Ishigaki et al.

It is certified that error appears in the above-identified patent and that said Letters Patent is hereby corrected as shown below:

Title page,
Item [73], Assignee, "Shigaki" should be -- Ishigaki --.

Signed and Sealed this

First Day of March, 2005

JON W. DUDAS
*Director of the United States Patent and Trademark Office*